US008651093B2

(12) United States Patent
Koyamaishi et al.

(10) Patent No.: US 8,651,093 B2
(45) Date of Patent: Feb. 18, 2014

(54) SLUDGE ADHESION INHIBITING STRUCTURE FOR INTERNAL COMBUSTION ENGINE

(75) Inventors: Naoto Koyamaishi, Susono (JP); Toshiaki Tanaka, Numazu (JP); Tetsushi Suzuki, Mishima (JP); Takashi Shimura, Susono (JP); Teru Ogawa, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 809 days.

(21) Appl. No.: 12/312,378

(22) PCT Filed: Nov. 9, 2007

(86) PCT No.: PCT/JP2007/072245

§ 371 (c)(1),
(2), (4) Date: May 7, 2009

(87) PCT Pub. No.: WO2008/056831

PCT Pub. Date: May 15, 2008

(65) Prior Publication Data

US 2010/0024762 A1 Feb. 4, 2010

(30) Foreign Application Priority Data

Nov. 9, 2006 (JP) ..... 2006-304515

(51) Int. Cl.
*F02B 25/06* (2006.01)

(52) U.S. Cl.
USPC ..... 123/572; 123/573; 123/574; 123/41.86

(58) Field of Classification Search
USPC ..... 123/572–574, 41.86
See application file for complete search history.

(56) References Cited

U.S. PATENT DOCUMENTS

| | | | | |
|---|---|---|---|---|
| 2,846,392 | A * | 8/1958 | Kolfenbach et al. | 508/522 |
| 4,756,821 | A * | 7/1988 | Giuliani et al. | 208/102 |
| 5,858,942 | A * | 1/1999 | Adams et al. | 510/185 |
| 6,325,037 | B1 * | 12/2001 | Takahashi et al. | 123/195 P |
| 7,055,488 | B2 * | 6/2006 | Tawa et al. | 123/196 W |
| 7,556,840 | B2 * | 7/2009 | Altin | 427/255.19 |
| 7,651,556 | B2 * | 1/2010 | Komiyama et al. | 106/14.44 |

(Continued)

FOREIGN PATENT DOCUMENTS

| | | |
|---|---|---|
| DE | 10-2004-016742 B3 | 9/2005 |
| JP | U-58-086416 | 6/1983 |

(Continued)

OTHER PUBLICATIONS

Feb. 19, 2010 Office Action issued in corresponding Japanese Patent Application No. 2006-304515 (with translation).

*Primary Examiner* — Marguerite McMahon
*Assistant Examiner* — James Kim
(74) *Attorney, Agent, or Firm* — Oliff PLC

(57) ABSTRACT

A sludge adhesion inhibiting structure for an internal combustion engine according to the present invention is characterized in that a sludge inhibiting layer inhibiting generation or adhesion of sludge is formed on a surface of an area inside the internal combustion engine into which oil as a liquid does not always spread and which is contacted by oil mist as a gas. Preferably, the sludge inhibiting layer is made up of a solid alkali substance. Furthermore, the sludge inhibiting layer is provided in a head cover and formed on an inner surface of an oil separator chamber separating the oil from a blow-by gas.

15 Claims, 7 Drawing Sheets

(56) References Cited

U.S. PATENT DOCUMENTS

| | | | | |
|---|---|---|---|---|
| 2003/0025406 | A1* | 2/2003 | Abe et al. | 310/45 |
| 2005/0022780 | A1* | 2/2005 | Imai et al. | 123/306 |
| 2005/0092267 | A1* | 5/2005 | Nonaka et al. | 123/41.86 |
| 2006/0165934 | A1* | 7/2006 | Okazaki et al. | 428/40.1 |
| 2006/0261004 | A1* | 11/2006 | Lockledge et al. | 210/502.1 |

FOREIGN PATENT DOCUMENTS

| | | |
|---|---|---|
| JP | A-63-131817 | 6/1988 |
| JP | U-63-160308 | 10/1988 |
| JP | A-02-252913 | 10/1990 |
| JP | A-09-013066 | 1/1997 |
| JP | A-11-236677 | 8/1999 |
| JP | A-2003-214132 | 7/2003 |
| JP | A-2003-336086 | 11/2003 |
| JP | A-2003-532516 | 11/2003 |
| JP | A-2004-346939 | 12/2004 |
| JP | A-2005-180284 | 7/2005 |
| JP | A-2005-226510 | 8/2005 |
| JP | A-2006-022700 | 1/2006 |
| JP | A-2006-299932 | 11/2006 |
| WO | WO 01/85300 A2 | 11/2001 |

* cited by examiner

SLUDGE ADHESION INHIBITING STRUCTURE FOR INTERNAL COMBUSTION ENGINE

TECHNICAL FIELD

The present invention relates to a sludge adhesion inhibiting structure for an internal combustion engine, and in particular, to a structure that inhibits possible adhesion of sludge to a particular area of the internal combustion engine.

BACKGROUND ART

It is known that in an internal combustion engine of an automobile or the like, oil as a lubricant may be deteriorated to generate sludge, which may affect relevant parts of the engine in various ways. The sludge contains olefin contained in the oil, NOx and SOx contained in a blow-by gas, and water as main components. The main components react in the presence of heat or acid to change to a precursor such as a sludge precursor or a sludge binder. Thus, the sludge is generated. The sludge appears to be mud or a slime-like substance. The sludge may disadvantageously deposit in, for example, a passage in the internal combustion engine to close the passage.

In particular, water generated inside the internal combustion engine by condensation or the like reacts with NOx and SOx contained in the blow-by gas to generate an acid substance. The acid substance serves as a catalyst for generation of sludge. Mixture of the acid substance into the oil promotes the generation of sludge, accelerates the deterioration of the oil, and degrades the functions of the lubricant.

In connection with the generation of the acid substance, conventional means adds an additive called a metal cleaning agent to the lubricant to neutralize the acid substance generated in the oil to inhibit the generation of sludge. Alternatively, a weak cationic surfactant is added to the oil to enhance the function of the oil for dispersion of the oil in the sludge (see, for example, Japanese Patent Application Laid-Open No. H9-13066(1997)).

The conventional art neutralizes and removes the acid substance contained in the oil to inhibit the generation of sludge. In other words, the main objective of the conventional art is to reduce the amount of sludge dispersed or diffused in the oil to inhibit the deterioration of the oil.

On the other hand, the sludge may disadvantageously adhere to or deposit in an area inside the internal combustion engine into which the oil does not always spread. That is, in an area into which the oil always spreads, even if sludge is generated, the sludge is washed away by the oil and is thus unlikely to adhere or deposit. However, in the area into which the oil does not always spread, the effect of washing away the sludge is not expected to work. Consequently, the adhesion or deposition may disadvantageously occur.

In view of these problems, an object of the present invention is to provide a sludge adhesion inhibiting structure for an internal combustion engine which can prevent the generation or adhesion of sludge in the area into which the oil does not always spread.

DISCLOSURE OF THE INVENTION

The present invention provides a sludge adhesion inhibiting structure for an internal combustion engine characterized in that a sludge inhibiting layer inhibiting generation or adhesion of sludge is formed on a surface of an area inside the internal combustion engine into which oil as a liquid does not always spread and which is contacted by oil mist as a gas.

According to the present invention, the sludge inhibiting layer enables inhibition of generation or adhesion of sludge on or to the surface of the area into which the oil does not always spread and which is contacted by the oil mist.

Preferably, the surface of the area is an inner surface of an area having an outer surface exposed to outside air.

As described above, water reacts with NOx and SOx to generate an acid substance, which then serves as a catalyst promoting the generation of sludge. On the other hand, condensed water is likely to be generated on the inner surface of the area having the outer surface exposed to the outside air. Thus, sludge is likely to be generated on or adhere to the inner surface. However, according to the second invention, the sludge inhibiting layer is formed on the inner surface of the area. This enables the effective inhibition of generation or adhesion of sludge on or to the surface on which the generation or adhesion of the sludge is inherently likely to occur.

Preferably, the surface of the area is an inner surface of a head cover covering a cylinder head.

Preferably, the surface of the area is an inner surface of a chain cover covering a timing chain.

Preferably, the surface of the area is an inner surface of an oil separator chamber separating oil from a blow-by gas.

For all of the head cover, the chain cover, and the oil separator chamber, the outer surface is likely to be exposed to the outside air and thus cooled. Consequently, condensed water is thus likely to be generated inside the head cover, the chain cover, and the oil separator chamber. Thus, for the head cover, the chain cover, and the oil separator chamber, the sludge inhibiting layer is provided on at least one of the inner surfaces. This enables the inhibition of generation or adhesion of sludge on or to the surface on which the generation or adhesion of sludge is inherently likely to occur.

Preferably, the sludge inhibiting layer comprises a solid alkali substance.

Thus, an acid substance generated on the surface of the area can be allowed to react chemically with the alkali substance for neutralization. Consequently, the acid substance, serving as a catalyst promoting the generation of sludge, can be neutralized and removed. Therefore, the generation or adhesion of sludge can be inhibited.

Preferably, the alkali substance comprises calcium carbonate.

Preferably, a surface of the sludge inhibiting layer is formed to have recesses and protrusions.

Compared to a construction in which the surface of the sludge inhibiting layer is flat, the present construction enables a substantial increase in the surface area of the sludge inhibiting layer, promoting a neutralizing reaction of the acid substance.

Preferably, the sludge inhibiting layer comprises at least one of an aggregate of a large number of particles and a foaming substance.

In this case, the contact area or reaction area between the sludge inhibiting layer and the acid substance can be increased to promote the neutralizing reaction of the acid substance. Furthermore, the acid substance can be physically absorbed or adsorbed and removed.

Preferably, the sludge inhibiting layer is formed by coating.

Thus, the sludge inhibiting layer can be relatively easily formed.

The present invention is very effective for inhibiting the generation, adhesion, or deposition of sludge on the area into which the oil does not always spread.

BEST MODE FOR CARRYING OUT THE INVENTION

A preferred embodiment of the present invention will be described below with reference to the accompanying drawings.

Figure 1:
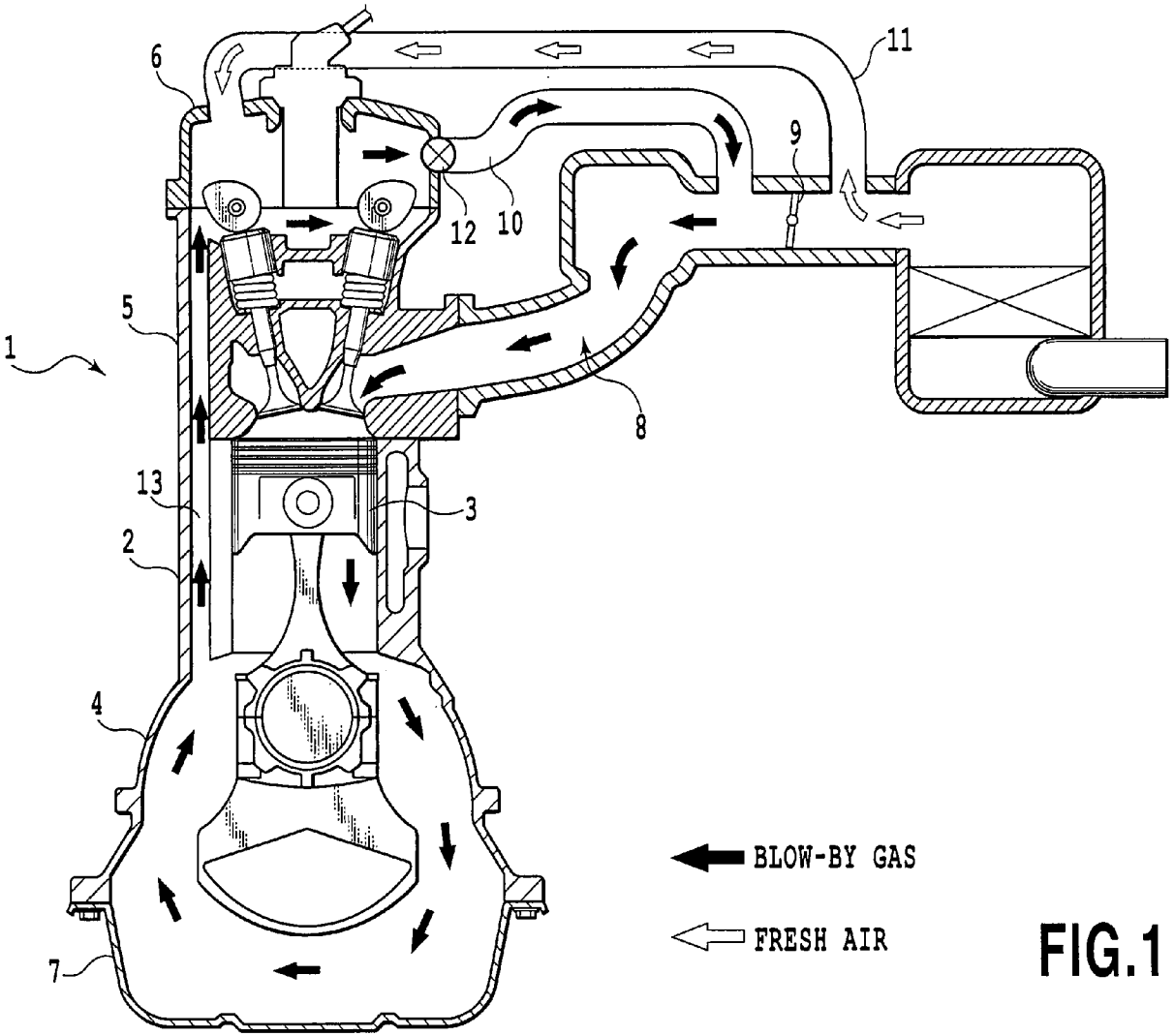
FIG. 1 is a schematic sectional view of an internal combustion engine according to an embodiment of the present invention.

FIG. 1 shows an internal combustion engine to which the present invention is applied, particularly a blow-by gas circulating apparatus for the internal combustion engine. As shown in FIG. 1, an engine 1 includes a cylinder block 2, a piston 3, a crank case 4, a cylinder head 5, a head cover 6 that covers the cylinder head 5 from above, and an oil pan 7. The blow-by gas is a gas leaking out into the crank case 4 through the gap between a piston ring and a cylinder bore in the cylinder block 2. The blow-by gas contains a large amount of hydrocarbon and moisture. Thus, an excessively large amount of blow-by gas causes engine oil to be deteriorated early or causes the interior of the engine to be rusted. Furthermore, releasing the blow-by gas, containing hydrocarbon, to the atmosphere intact is not environmentally preferable. Thus, the blow-by gas is forcibly returned to an intake system through a path described below, utilizing an intake negative pressure. Arrows in the figure show the flow of the blow-by gas and fresh air observed when a light load is imposed on the engine.

An intake passage 8 includes a throttle valve 9. A part of the intake passage 8 located downstream of the throttle valve 9 communicates with the interior of the head cover 6 via a PCV passage 10. Here, PCV is an abbreviation of a Positive Crankcase Ventilation. A part of the intake passage 8 located upstream of the throttle valve 9 communicates with the head cover 6 via an air passage 11. A PCV valve 12 is provided in the PCV passage 10 to open and close the PCV passage 10. The PCV valve 12 is opened and closed depending on the magnitude of an intake negative pressure, to change flow rate. In the present embodiment, the PCV valve 12 is fixedly provided on the head cover 6.

An oil drop passage 13 is formed in the cylinder block 2 and the cylinder head 5 to allow the interior of the head cover 6 to communicate with the interior of the crank case 4. The oil drop passage 13 according to the present embodiment allows oil remaining on the cylinder head 5 after lubrication of a valve operating system to fall onto the oil pan 7. The oil drop passage 13 also allows the blow-by gas in the crank case 4 to move upward to the interior of the head cover 6. The blow-by gas moving upward from the crank case 4 to the head cover 6 contains oil mist generated by agitation and evaporation of the oil in the crank case 4.

As shown in FIG. 1, while a light load is imposed on the engine, the PCV valve 12 is opened to return the blow-by gas in the crank case 4 to the intake passage 8 through the oil drop passage 13, the interior of the head cover 6, and the PCV passage 10 in this order. The blow-by gas is thereafter combusted in a combustion chamber in the cylinder block 2. On the other hand, air is introduced into the head cover 6 through an air passage 11. The air appropriately dilutes the blow-by gas in the head cover 6.

On the other hand, although not shown in the drawings, when a heavy load is imposed on the engine, the PCV valve 12 is closed to return the blow-by gas in the head cover 6 to the intake passage 8 through the air passage 11.

As described above, the blow-by gas in the crank case 4 is introduced into the head cover 6 and then returned to the intake passage 8 for combustion. The blow-by gas contains not only HC (HydroCarbon) that is a fuel component, NOx and SOx contained in a combusted gas, and moisture but also the oil mist, that is, a gas generated by the agitation and evaporation of the oil in the crank case 4. Thus, when the blow-by gas is simply circulated to the intake side, the oil is simultaneously combusted. Consequently, oil consumption increases, and the combusted oil may disadvantageously produce white fume.

Thus, an oil separator chamber, described below in detail, is partitioned and formed in the head cover 6 to separate the oil from the blow-by gas. The oil separator chamber allows the oil to be separated from the blow-by gas and collected before the blow-by gas is returned to the intake system. As a result, the above-described problem can be solved.

Figure 2:
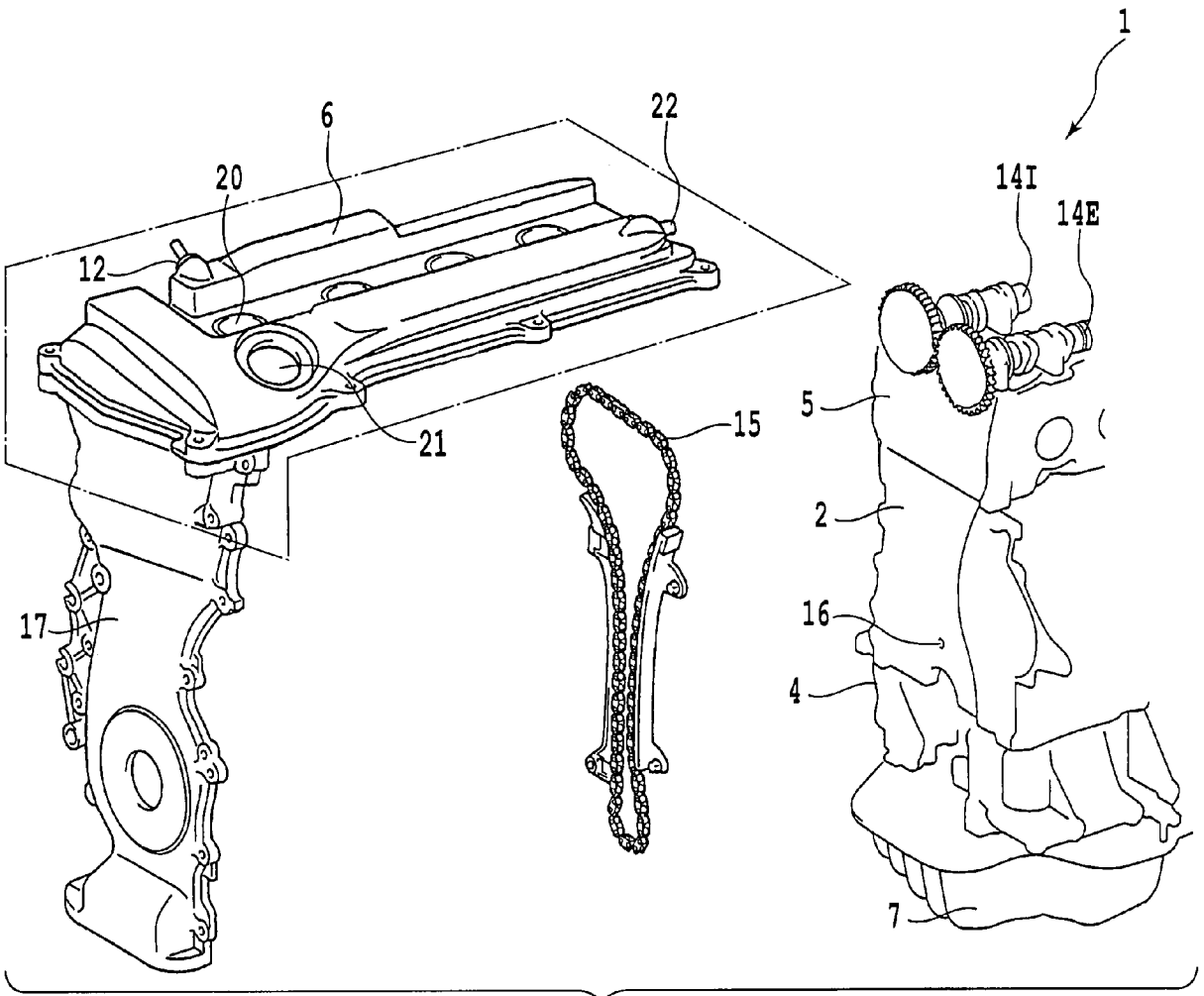
FIG. 2 is a perspective view of a part of the assembled internal combustion engine according to the embodiment of the present invention.

FIG. 2 shows the appearance of the engine 1. As shown in FIG. 2, at one end of the engine 1 in the direction of a crank shaft, two cam shafts, that is, an intake side cam shaft 14I and an exhaust side cam shaft 14E, are rotationally driven by the crank shaft (not shown in the drawings) via a timing chain 15. The timing chain 15 is supplied with oil injected by an oil jet 16 provided in the cylinder block 2. The timing chain 15 is laterally covered with a chain cover 17. The chain cover 17 is fastened to the cylinder block 2 and the crank case 4. The head cover 6 is partly fastened to the upper end surface of the chain cover 17. The oil pan 7 is partly fastened to the lower end surface of the chain cover 17. Thus, a space partitioned from the exterior is formed in the chain cover 17.

The head cover 6 has plug holes 20 provided along the longitudinal direction thereof and the number of which is the same as that of cylinders (in the present embodiment, four cylinders), and an oiling port 21 that is openably closed by a cap (not shown in the drawings). The PCV valve 12 is attached to the head cover 6, and a pipe joint 22 to which piping making up the air passage 11 is attached is also attached to the head cover 6.

Figure 3:
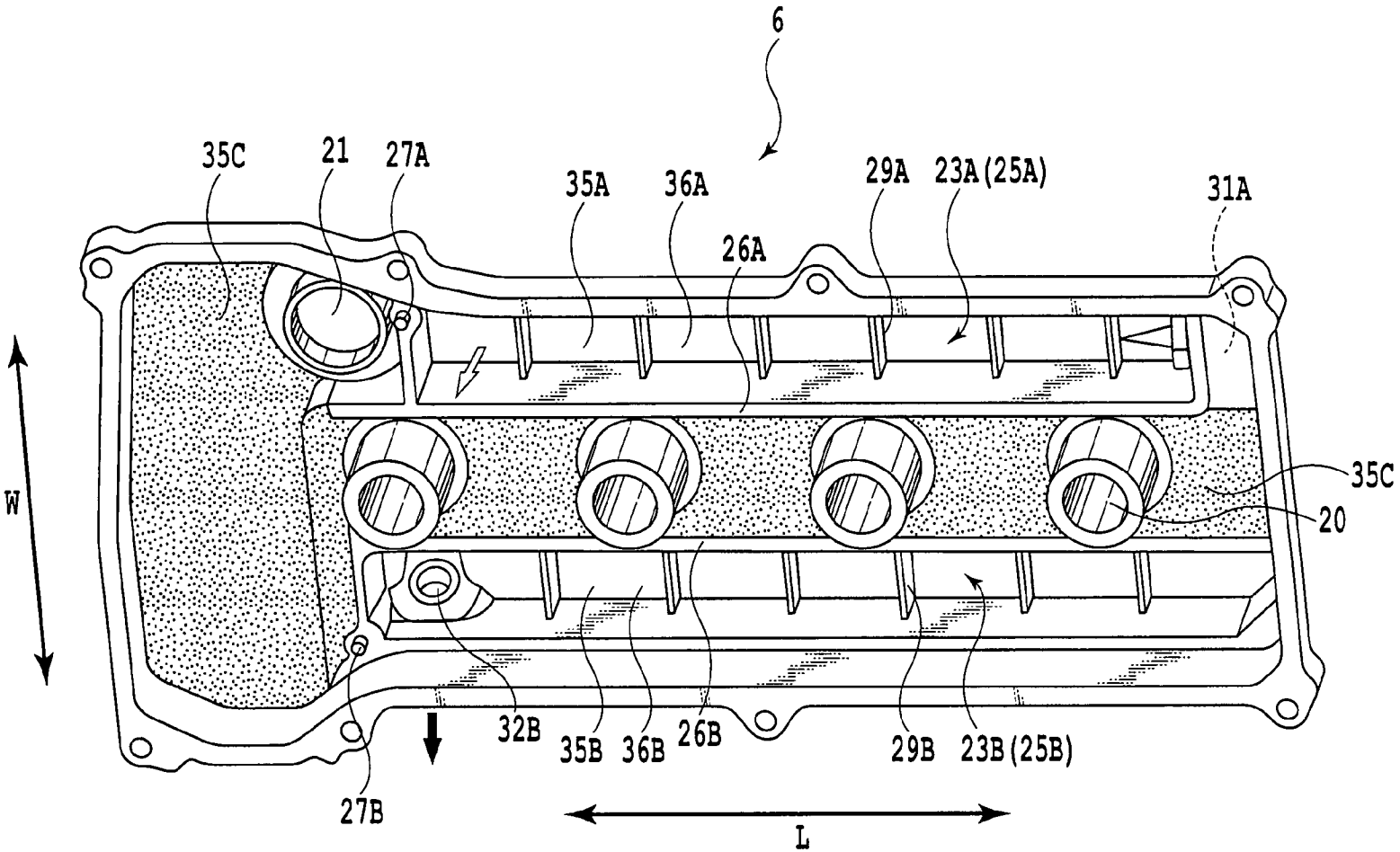
FIG. 3 is a perspective view of a head cover as viewed from below and behind the head cover.

FIG. 3 is a perspective view of the head cover 6 as viewed from behind. As shown in FIG. 3, two grooves 23A and 23B are formed in the upper part of the rear side of the head cover 6 to partition and form the oil separator chamber. The grooves 23A and 23B extend in the longitudinal direction L of the head cover 6 and are formed on one side and the other side, respectively, of the plug holes 20 in a width direction W. The side in the width direction W on which the groove 23A is formed is hereinafter referred to as the "front" side. The side in the width direction W on which the groove 23B is formed is hereinafter referred to as the "rear" side. These directions correspond to the front-back direction of the vehicle observed when the engine 1 is transversely placed in the vehicle as shown in FIG. 2.

Figure 4:
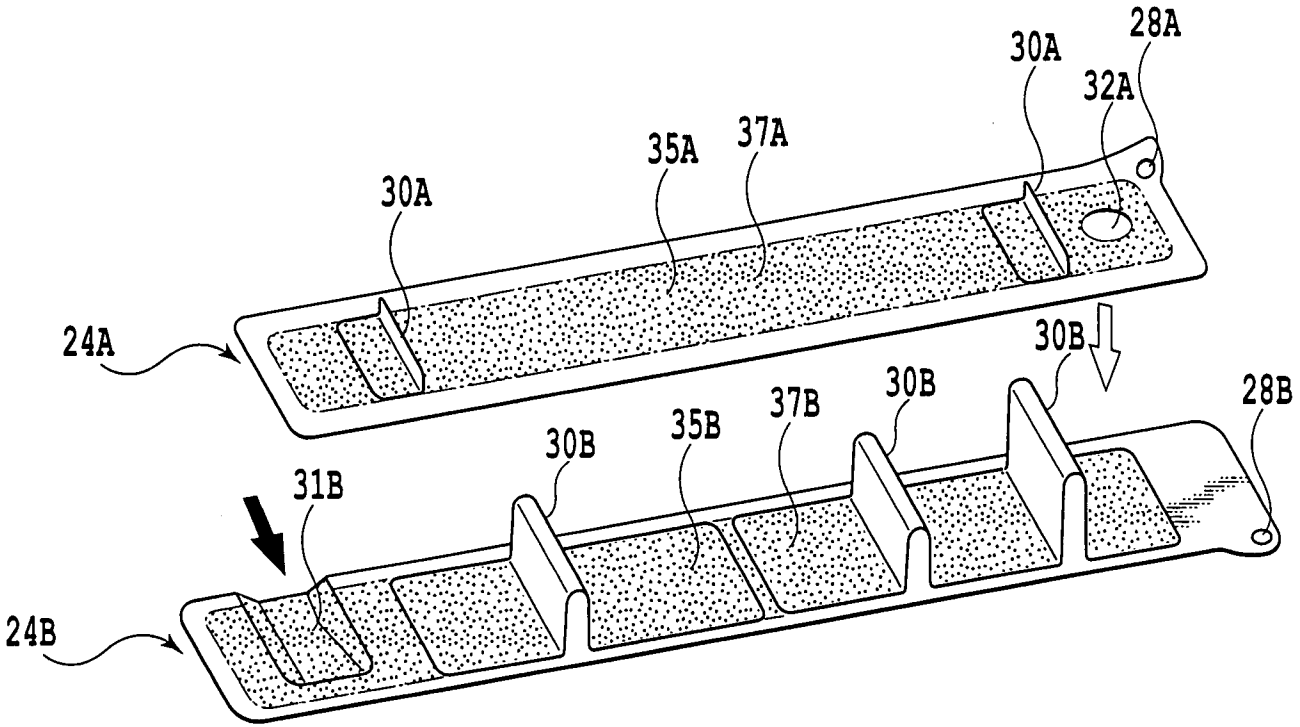
FIG. 4 is a perspective view of a baffle plate as viewed from above.

The front and rear grooves 23A and 23B are closed by two substantially rectangular baffle plates 24A and 24B as shown in FIG. 4. Thus, one oil separator chamber 25A partitioned by the groove 23A and the baffle plate 24A is formed in the front of the head cover 6. One oil separator chamber 25B partitioned by the groove 23B and the baffle plate 24B is formed in the rear of the head cover 6. The front and rear oil separator chambers 25A and 25B are separate from and independent of each other.

The baffle plates 24A and 24B are inverted in both vertical direction and lateral direction. The peripheral parts of the baffle plates 24A and 24B are joined to junction surfaces 26A and 26B, respectively, formed on the peripheral parts of the grooves 23A and 23B in the head cover 6 and shaped like rectangular frames. The baffle plates 24A and 24B are then fixed to the head cover 6 by fastening means such as welding or bolting. The baffle plates 24A and 24B are aligned with each other using aligning pins 27A and 27B provided on the junction surfaces 26A and 26B, respectively, and aligning holes 28A and 28B formed in the baffle plates 24A and 24B, respectively. The oil separator chambers 25A and 25B thus formed are essentially closed spaces except for a gas inlet and a gas outlet described below.

Figure 5:
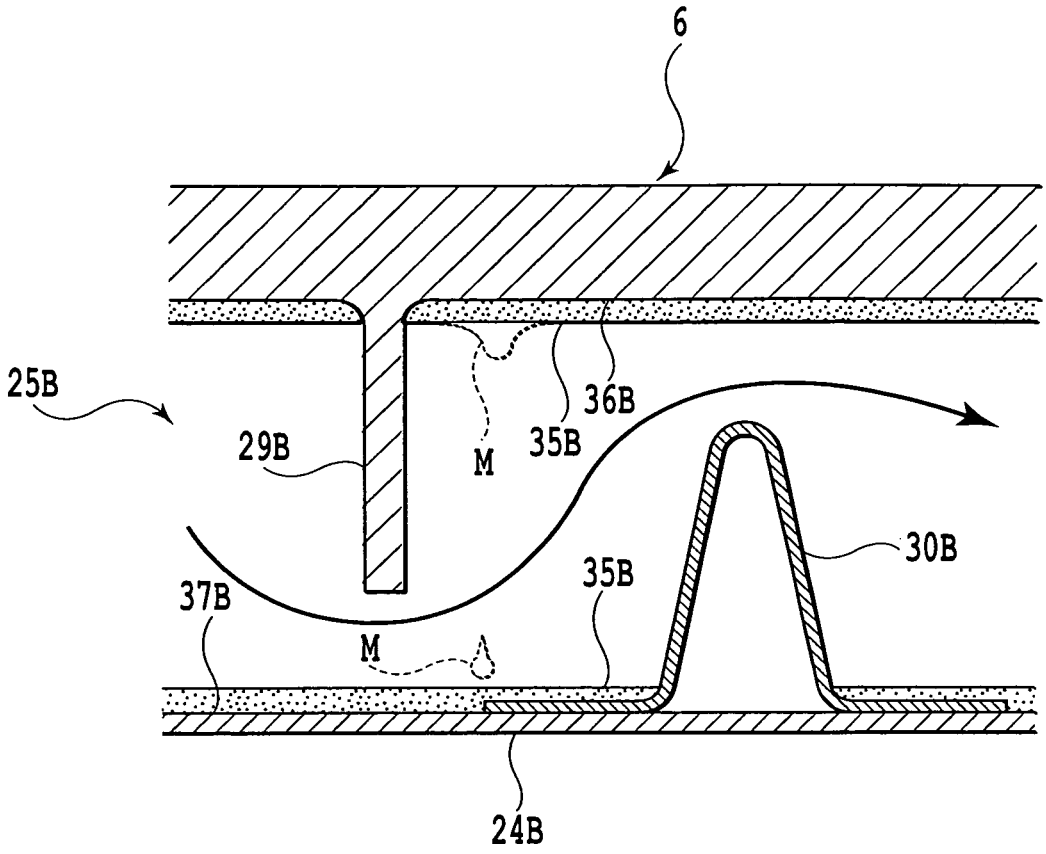
FIG. 5 is a sectional view showing a part of an oil separator chamber.

In the head cover 6, a plurality of baffle boards 29A and 29B are integrally provided upright at the bottom positions of the grooves 23A and 23B at predetermined intervals in the longitudinal direction. A plurality of baffle boards 30A and 30B are also provided upright on the top surfaces of the baffle plates 24A and 24B, respectively, at predetermined intervals in the longitudinal direction. Referring to FIG. 5, the upper and lower baffle boards 29A, 29B and 30A, 30B are alternately arranged in the longitudinal direction L when the baffle plates 24A and 24B are assembled together. Thus, a meandering passage is defined through which the blow-by gas flows in the longitudinal direction L. Consequently, while flowing in the longitudinal direction of the oil separator chambers 25A and 25B, the blow-by gas is bent, thus promoting the separation of the oil from the blow-by gas. Various passage structures for the oil separator chamber are known. Besides the vertically meandering structure, any of the following may be used: a laterally meandering structure, a structure obtained by combining the vertically meandering structure and the laterally meandering structure, and a more complicated labyrinth structure. Regardless of whichever passage structure is adopted, the present invention is applicable.

As shown in FIG. 3, in the front oil separator chamber 25A, an air entry 31A is formed at a right end surface of the groove 23A. The air entry 31A is connected to the pipe joint 22 to serve as an air intake port. Furthermore, as shown in FIG. 4, an air outlet hole 32A is formed at the left end (the right end in FIG. 4) of the baffle plate 24A in the attached state.

Thus, to be introduced into the head cover 6, air flows, as shown by white arrows in FIGS. 3 and 4, first from the air entry 31A into the front oil separator chamber 25A, then from right to left (in FIGS. 3 and 4) in the front oil separator chamber 25A, and finally out from the outlet hole 32A. Furthermore, with a heavy load imposed on the engine, when the blow-by gas is returned to the intake side through the front oil separator chamber 25A, the flows direction is reversed. The blow-by gas flows from the outlet hole 32A into the oil separator chamber 25A and then from left to right (in FIGS. 3 and 4) in the oil separator chamber 25A. At this time, the oil is separated from the blow-by gas. The blow-by gas from which the oil has been separated flows out from the air entry 31A to the air passage 11. The separated oil is dropped from the outlet hole 32A.

On the other hand, in the rear oil separator chamber 25B, as shown in FIG. 4, a blow-by gas inlet groove 31B is formed at the right end (in FIG. 4, the left end) of the baffle plate 24B in the attached state. The inlet groove 31B also serves as a drop hole for the oil collected in the oil separator chamber 25B. Furthermore, as shown in FIG. 3, an outlet hole 32B for the blow-by gas flowing backward is formed at the left end of the groove 23B. The outlet hole 32B is connected to the PCV valve 12.

Thus, to return to the intake side, the blow-by gas flows, as shown by black arrows in FIGS. 3 and 4, first from the inlet groove 31B into the rear oil separator chamber 25B and then from right to left in the rear oil separator chamber 25B. At this time, the oil is separated from the blow-by gas. The blow-by gas from which the oil has been separated flows out from the outlet hole 32B to the PCV passage 10. The separated oil is dropped from the inlet hole 31B.

The oil mist as a gas contained in the blow-by gas is present in the oil separator chambers 25A and 25B. The inner walls of the oil separator chambers 25A and 25B are contacted by the oil mist. However, the oil does not always spread into the oil separator chambers 25A and 25B. In other words, the oil is not positively allowed to flow through the oil separator chambers 25A and 25B. Thus, sludge is likely to be generated and to adhere to or deposit on the inner surfaces of the oil separator chambers 25A and 25B.

More specifically, NOx and SOx contained in the blow-by gas reacts with water resulting from condensation to generate an acid substance. The acid substance serves as a catalyst for the generation of sludge. On the other hand, the blow-by gas in the oil separator chambers 25A and 25B contains NOx and SOx. Furthermore, transmitting heat from the engine to the head cover 6 is difficult. The outer surface of the head cover 6 is exposed to outside air and cooled by cooling wind. Thus, condensed water is likely to be generated on the inner surface of the head cover 6. Consequently, an acid substance is likely to be generated in the oil separator chambers 25A and 25B. As a result, sludge is likely to be generated and the adhesion or deposition thereof is likely to occur. Additionally, the oil is not positively allowed to flow through the oil separator chambers 25A and 25B. Thus, the sludge generated is not expected to be washed away.

When the sludge adheres to or deposit on the inner surfaces of the oil separator chambers 25A and 25B, the blow-by gas passages formed in the oil separator chambers 25A and 25B are substantially closed, thus degrading oil separation performance. Consequently, a large amount of oil mist in the blow-by gas is returned to the intake side. This disadvantageously increases the oil consumption and causes white fume to be generated as a result of combustion of the oil.

Thus, in the present embodiment, to inhibit sludge from being generated in or adhering to an area such as the oil separator chambers 25A and 25B into which the oil does not essentially spread, a sludge inhibiting layer is formed on the surface of the area. The sludge inhibiting layer is shown by dotted parts in FIGS. 3 and 4.

The sludge inhibiting layer is preferably made up of a solid alkali substance. For example, calcium carbonate ($CaCO_3$) is used as the alkali substance. For example, in the rear oil separator chamber 25B, a sludge inhibiting layer 35B is formed on the bottom surface of the groove 23B, which corresponds to the inner surface of the head cover 6, and on the top surface of the baffle plate 24B. That is, as also shown in FIG. 5, the sludge inhibiting layer is formed on the top surface (ceiling layer) 36B and bottom surface (floor surface) 37B in the oil separator chamber 25B.

In the present embodiment, the sludge inhibiting layer 35B is formed all over the top surface 36B and bottom surface 37B in the oil separator chamber 25B but may be provided exclusively on a part of the top surface 36B and bottom surface 37B. The formation of the sludge inhibiting layer 35B reduces the area of the passages in the chambers by an amount corresponding to the thickness of the sludge inhibiting layer 35B. To minimize the reduction in passage area, the present embodiment avoids forming the sludge inhibiting layer 35B on the baffle boards 29B and 30B. However, forming the sludge inhibiting layer 35B on the baffle boards 29B and 30B is optional. As shown in FIG. 4, the sludge inhibiting layer is not formed in the peripheral part of the top surface of the baffle plate 24B, which part is joined to the junction surfaces 26A and 26B of the head cover 6.

The top surface 36B of the oil separator chamber 25B is located on the back of or inside the outer surface of the head cover, which is exposed to the outside air. Thus, as shown by dotted lines in FIG. 5, water M is likely to be generated on the top surface 36B by condensation and then to fall onto the bottom surface 37B. Then, as a result of the reaction between the water M and NOx and SOx, an acid substance is likely to be generated on the top surface 36B and the bottom surface 37B. However, in the present embodiment, a sludge inhibiting layer 35A is formed on the top surface 36B and the bottom surface 37B. Thus, the acid substance generated on the top surface 36B and the bottom surface 37B can be effectively neutralized, thus inhibiting the generation and adhesion of sludge.

On the other hand, the front oil separator chamber 25A is similarly constructed. The sludge inhibiting layer 35A is formed only all over the top surface (ceiling surface) 36A and bottom surface (floor surface) 37A of the oil separator chamber 25A.

As described above, the sludge inhibiting layers 35A and 35B, made up of the alkali substance, is provided on the inner surfaces of the oil separator chambers 25A and 25B, respectively, into which the oil does not always spread and which is contacted by the oil mist. Then, the acid substance generated can be allowed to reach with the alkali substance and thus neutralized. This enables removal of the acid substance, which promotes the generation of sludge, thus allowing inhibition of generation and adhesion or deposition of sludge.

Furthermore, the acid substance generated is neutralized and removed. Thus, simultaneously with the inhibition of generation and adhesion or deposition of sludge, possible dissolution of the acid substance into the oil can be inhibited, which may deteriorate the oil.

In the present embodiment, as shown in FIG. 3, a sludge inhibiting layer 35C is also formed on a part of the inner surface of the head cover other than the front and rear oil separator chambers 25A and 25B. The head cover 6 is likely to be entirely cooled. Thus, the sludge inhibiting layer 35C is preferably formed on the inner surface of the head cover except for the front and rear oil separator chambers 25A and 25B, as in the case of the present embodiment.

As is appreciated from the above description, in the present embodiment, the sludge inhibiting layer, which neutralizes the acid substance, is provided on the surface of the area into which the oil does not always spread and which is contacted by the oil mist. Thus, the present embodiment is essentially different from such a conventional technique as described in Japanese Patent Application Laid-Open No. H9-13066(1997) in which an additive is mixed into oil in order to neutralize an acid substance mixed into the oil.

Figure 6A:
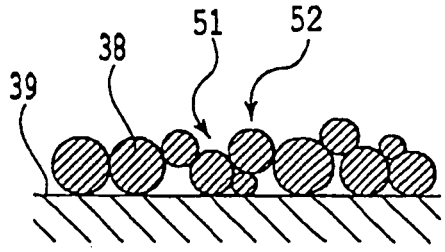
FIGS. 6A to 6E are enlarged sectional views showing a method of forming a sludge inhibiting layer and the structure of the sludge inhibiting layer.
Figure 6B:
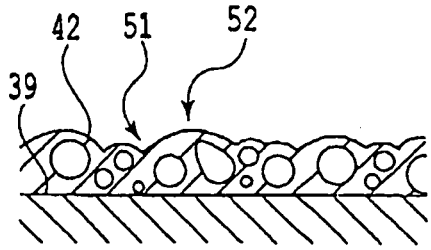
Figure 6C:
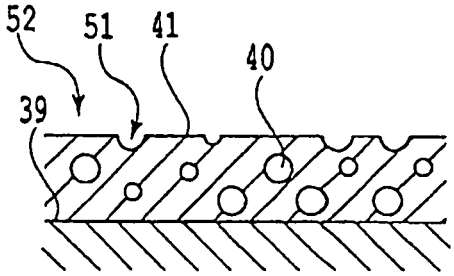
Figure 6D:
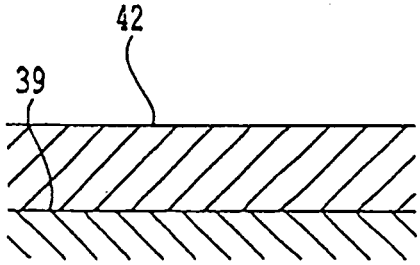
Figure 6E:
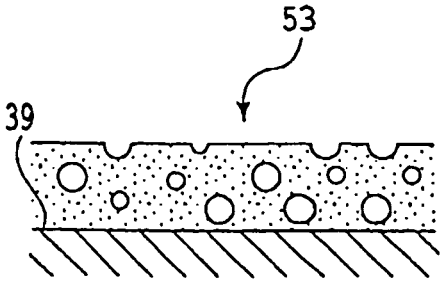

Examples of a method for forming sludge inhibition layers 35A and 35B will be described below. For example, as shown in FIG. 6A, a large number of particles 38 made up of an alkali substance are distributively arranged on a target surface. The particles are fixedly bonded to the target surface 39 with an adhesive. Thus, the sludge inhibiting layers 35A and 35B are made up of an aggregate of the large number of particles. In the illustrated example, the particles 38 are solid. However, the particles 38 may be hollow. Another method is as follows. As shown in FIG. 6B, the alkali substance is dispersed in a solution, which is then coated on the target surface in the form of foam or mousse. The solution is then dried to immobilize the alkali substance 42 to the target surface 39. In this case, the sludge inhibiting layers 35A and 35B are made up of a foaming substance. Yet another method is as follows. As shown in FIG. 6C, a plate 41 (for example, a pumice plate) of an alkali substance with a large number of holes 40 formed inside is produced and then fixed to the target surface 39. Also in this case, the sludge inhibiting layers 35A and 35B are made up of a foaming substance. Still another method is as follows. As shown in FIG. 6D, a solution with an alkali substance dispersed therein is coated on the target surface 39 with a brush or by spraying. The solution is then dried to immobilize the alkali substance 42 to the target surface 39. In this case, each of the sludge inhibiting layers 35A and 35B is made up of a single layer with substantially no hole and can thus be relatively easily formed. The surface of each of the sludge inhibiting layers 35A and 35B is formed to have recesses 51 and protrusions 52 in the structures shown in FIGS. 6A to 6C and to be flat in the structure shown in FIG. 6D. As shown in FIG. 6E, the sludge inhibition layers may also comprise a sponge 53.

At least any two of the above-described methods and structures obtained by the methods can be combined together depending on the target area. In particular, compared to the structure shown in FIG. 6D, the structures shown in FIGS. 6A to 6C enable a substantial increase in the surface area of the sludge inhibiting layers. The structures shown in FIGS. 6A to 6C also enable an increase in the contact area or reaction area between the acid substance and the sludge inhibiting layers to promote the neutralizing reaction of the acid substance. Furthermore, the structures shown in FIGS. 6A to 6C allow the acid substance to be physically absorbed or adsorbed. Furthermore, the sludge inhibiting layers composed of a sponge 53 containing an alkali substance facilitates the absorption and adsorption. This also enables the removal of the acid substance and the inhibition of generation and adhesion of the sludge.

The forming methods for and the structures of the sludge inhibiting layers are not limited to those described above. For example, such a single layer structure as shown in FIG. 6D may be formed such that the surface thereof has recesses 51 and protrusions 52 to substantially increase the surface area thereof.

The present inventors carried out comparative experiments on the present embodiment. Then, when the sludge inhibiting layer was not provided on the top and bottom surface of the oil separator chamber, a significant amount of slime-like sludge adhered to and deposited on the top and bottom surfaces of the oil separator chamber. In contrast, when the sludge inhibiting layer was provided on the top and bottom surfaces of the oil separator chamber, almost no sludge adhered to the top and bottom surfaces of the oil separator chamber. Thus, the effects of the present invention were confirmed.

The area on which the sludge inhibiting layer is formed is not limited to the oil separator chambers or any part of the head cover other than the oil separator chambers. The sludge inhibiting layer is preferably formed in an area enclosed by an alternate long and short dash line in FIG. 2. However, the area includes not only the head cover 6 but also the chain cover 17, particularly the upper part thereof. Like the head cover 6, the chain cover 17 has an outer surface exposed to the outside air and is thus likely to be cooled. Furthermore, the upper part of the chain cover 17 is unlikely to receive heat from the engine, and the low temperature of the engine is transferred to the upper part of the chain cover 17. Thus, water is likely to be generated on the chain cover 17, particularly the inner surface of the upper part thereof by condensation. Furthermore, in the space inside the chain cover 17, the blow-by gas contained in the oil is dissipated and the oil mist is present. Thus, the oil as a liquid is prevented from flowing. Only an amount of oil required and sufficient for lubrication is supplied by the oil jet 16. Consequently, the oil does not flow in the chain cover 17. Therefore, the sludge inhibiting layer is preferably formed on the chain cover 17, particularly the inner surface of the upper part thereof.

Figure 7:
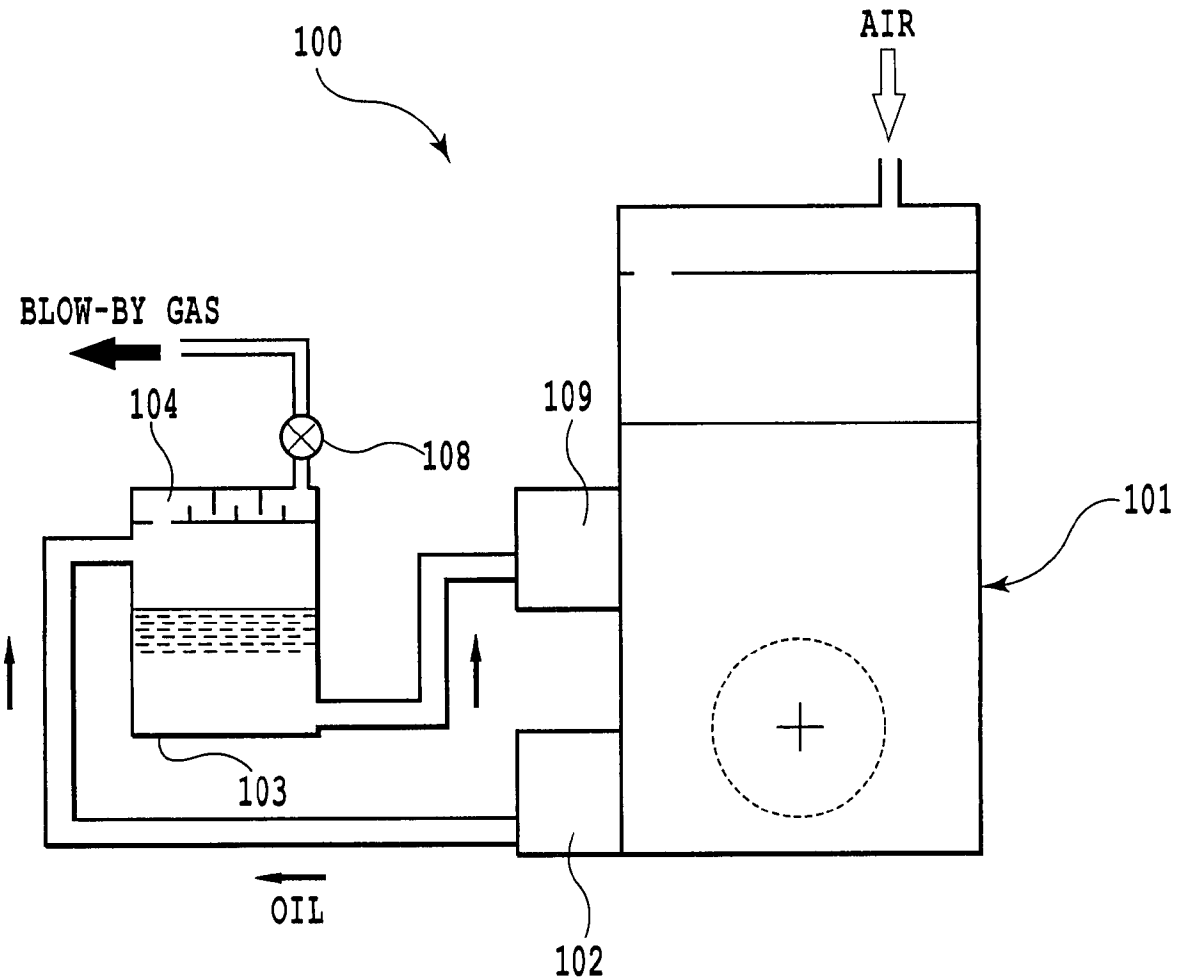
FIG. 7 is a schematic diagram of the construction of a dry sump engine to which the present invention is applicable.

In addition, the following area is suitable for the formation of the sludge inhibiting layer. FIG. 7 schematically shows a dry sump engine 100. The dry sump engine 100 does not have an oil pan serving as an oil reservoir, on an engine main body 101 side. Instead, oil is sucked from the bottom of the engine main body 101 using a scavenging pump 102. The oil is then collected in a separately and independently installed oil tank 103. The oil stored in the oil tank 103 circulatively fed to each of the circulating portions of the engine 100 using a feed pump 109.

A blow-by gas is mixed into the oil collected in the oil tank 103. Consequently, the blow-by gas and oil mist are generated in the oil tank 103. Thus, as described above, an oil separator chamber 104 is formed at the upper end of the oil tank 103 to separate the oil from the blow-by gas. The sludge inhibiting layer is also preferably formed on the inner surface of the oil separator chamber 104, particularly the inner top and bottom surfaces thereof. The blow-by gas from which the oil has been separated in the oil separator chamber 104 of the oil tank 103 is returned to the intake side through a PCV valve 108.

Alternatively, the oil separator chamber may be installed adjacent to a crankcase or a cylinder block. Also in this case, the sludge inhibiting layer is preferably formed on the inner surface of the oil separator chamber.

The preferred embodiment of the present invention has been described. However, according to the present invention, any other embodiment may be adopted. For example, as the alkali substance making up the sludge inhibiting layer, any alkali substance other than calcium carbonate may be used. Furthermore, the sludge inhibiting layer may be formed on any of various other areas.

In the above-described embodiment, the sludge inhibiting layer is formed on each of the top and bottom surfaces of the oil separator chamber. However, the sludge inhibiting layer may be formed exclusively on the top or bottom surface of the oil separator chamber. Furthermore, in the above-described embodiment, the oil separator chamber is provided in the head cover so that the inner surface of the head cover also serves as the top surface of the oil separator chamber. However, if the oil separator chamber is not provided in the head cover, the sludge inhibiting layer may independently be formed on the inner surface of head cover. Alternatively, if the oil separator chamber is provided in the head cover, the sludge inhibiting layer may be formed on any part of the inner surface of the head cover other than the oil separator chamber. The position at which the oil separator chamber is installed is not particularly limited. In particular, if the oil separator chamber has an outer surface exposed to the outside air, the sludge inhibiting layer is preferably installed on the inner surface of the oil separator chamber, which is positioned on the back of the outer surface thereof.

The embodiment of the present invention is not limited to the one described above. The present invention includes any variations, applications, and equivalents embraced in the concept of the present invention specified in the claims. Thus, the present invention should not be limitedly interpreted but is applicable to any other technique belonging to the scope of the present invention.

INDUSTRIAL APPLICABILITY

The present invention is applicable to an internal combustion engine for which generation or adhesion of sludge is desirably inhibited.

The invention claimed is:

1. A sludge adhesion inhibiting structure for an internal combustion engine, comprising:

a sludge inhibiting layer that inhibits generation or adhesion of sludge, the sludge inhibiting layer being formed on a surface of an area inside the internal combustion engine into which clean lubricating oil does not contact the surface of the area, the surface of the area being contacted by a blow-by gas and oil mist as a gas, wherein:

the sludge inhibiting layer includes a liquid solution or a foaming solution with solid alkaline particles dispersed in the liquid solution or the foaming solution, the surface of the area is an inner surface of the area exposed to outside air, and the sludge inhibiting layer is configured to chemically neutralize an acid substance generated by reaction between condensed water generated on the surface of the area and NOx and SOx contained in the blow-by gas to inhibit generation or adhesion of the sludge.

2. The sludge adhesion inhibiting structure for the internal combustion engine according to claim 1, wherein the surface of the area is an inner surface of a head cover covering a cylinder head.

3. The sludge adhesion inhibiting structure for the internal combustion engine according to claim 1, wherein the surface of the area is an inner surface of a chain cover covering a timing chain.

4. The sludge adhesion inhibiting structure for the internal combustion engine according to claim 1, wherein the surface of the area is an inner surface of an oil separator chamber separating oil from a blow-by gas.

5. The sludge adhesion inhibiting structure for the internal combustion engine according to claim 1, wherein the alkali substance comprises calcium carbonate.

6. The sludge adhesion inhibiting structure for the internal combustion engine according to claim 1, wherein a surface of the sludge inhibiting layer is formed to have recesses and protrusions.

7. The sludge adhesion inhibiting structure for the internal combustion engine according to claim 1, wherein the sludge inhibiting layer is formed by coating.

8. The sludge adhesion inhibiting structure for the internal combustion engine according to claim 1, wherein the surface of the area is a bottom surface of an oil separator chamber provided in a head cover and having a top surface formed by the head cover.

9. The sludge adhesion inhibiting structure for the internal combustion engine according to claim 8, further comprising:

a baffle board on which the sludge inhibiting layer is not formed is provided in the oil separator chamber so as to define a meandering passage.

10. The sludge adhesion inhibiting structure for the internal combustion engine according to claim 1, wherein the sludge inhibiting layer comprises alkali particles that are distributively arranged on the surface of an area inside the internal combustion engine and fixed to the surface of an area inside the internal combustion engine with an adhesive.

11. The sludge adhesion inhibiting structure for the internal combustion engine according to claim 1, wherein a contact area between the sludge inhibiting layer and the acid substance is increased to promote the neutralizing reaction of the acid substance.

12. A sludge adhesion inhibiting structure for an internal combustion engine, comprising:

a sludge inhibiting layer that inhibits generation or adhesion of sludge, the sludge inhibiting layer being formed on a surface of an area inside the internal combustion engine into which liquid clean lubricating oil does not contact the surface of the area, the surface of the area being contacted by a blow-by gas and oil mist as a gas, wherein:

the sludge inhibiting layer includes a plate of an alkali substance having a large number of holes inside, the surface of the area is an inner surface of the area exposed to outside air, and the sludge inhibiting layer is configured to chemically neutralize an acid substance generated by reaction between condensed water generated on the surface of the area and NOx and SOx contained in the blow-by gas to inhibit generation or adhesion of the sludge.

13. The sludge adhesion inhibiting structure for the internal combustion engine according to claim 12, wherein the alkali substance comprises calcium carbonate.

14. A sludge adhesion inhibiting structure for an internal combustion engine, comprising:

a sludge inhibiting layer that inhibits generation or adhesion of sludge, the sludge inhibiting layer being formed on a surface of an area inside the internal combustion engine into which clean lubricating oil does not contact the surface of the area, the surface of the area being contacted by a blow-by gas and oil mist as a gas, wherein:

the sludge inhibiting layer includes a sponge containing a solid alkali substance, the surface of the area is an inner surface of the area exposed to outside air, and the sludge inhibiting layer is configured to chemically neutralize an acid substance generated by reaction between condensed water generated on the surface of the area and NOx and SOx contained in the blow-by gas to inhibit generation or adhesion of the sludge.

15. The sludge adhesion inhibiting structure for the internal combustion engine according to claim 14, wherein the alkali substance comprises calcium carbonate.

* * * * *